US005163305A

United States Patent [19]

Tenconi

[11] Patent Number: 5,163,305

[45] Date of Patent: Nov. 17, 1992

[54] KNITTING MACHINE WITH STITCH RETENTION SINKERS

[75] Inventor: Riccardo Tenconi, Varese, Italy

[73] Assignee: MEC-MOR S.r.l., Milano, Italy

[21] Appl. No.: 587,183

[22] Filed: Sep. 24, 1990

[30] Foreign Application Priority Data

Oct. 3, 1989 [IT] Italy ..... 21905 A/89

[51] Int. Cl.[5] ..... D04B 15/00

[52] U.S. Cl. ..... 66/104

[58] Field of Search ..... 66/104, 106, 107, 90, 66/112

[56] References Cited

U.S. PATENT DOCUMENTS

| | | | |
|---|---|---|---|
| 1,652,308 | 12/1927 | Howie | 66/90 |
| 2,685,785 | 8/1954 | Capdevila | 66/13 |
| 4,741,181 | 5/1988 | Plath | 66/106 X |
| 4,751,829 | 6/1988 | Plath | 66/106 X |

FOREIGN PATENT DOCUMENTS

| | | | |
|---|---|---|---|
| 1435187 | 1/1969 | Fed. Rep. of Germany . | |
| 3132958 | 3/1983 | Fed. Rep. of Germany | 66/90 |
| 1467337 | 3/1977 | United Kingdom . | |
| 1558812 | 1/1980 | United Kingdom . | |
| 2145436 | 3/1985 | United Kingdom | 66/106 |

*Primary Examiner*—Werner H. Schroeder
*Assistant Examiner*—John J. Calvert

[57] ABSTRACT

The machine has needles accommodated in grooves defined in a needle-holder element. The needles are controllably movable along the related groove from an extraction position, in which the tip of the needles protrudes from the related groove to grip at least one thread fed by a thread guide, to a retracted position, in which the tip of the needles is retracted in the related groove to form a loop of knitting with the engaged thread, and vice versa. A plurality of sinkers are arranged alternated with the needles, each sinker being arranged laterally to a needle. Each of the sinkers has an end which is located proximate to the tip of the related needle in retracted position and has a tip directed toward the bottom of the related groove and curved toward the related needle. Actuation elements act on each sinker to insert their tip in the loop being formed on the related needle proximate to the retracted-position.

11 Claims, 2 Drawing Sheets

KNITTING MACHINE WITH STITCH RETENTION SINKERS

BACKGROUND OF THE INVENTION

The present invention relates to a knitting machine with stitch retention sinkers.

As known, in both rectilinear and circular knitting machines with one or two needle holders, during some particular knitting it is necessary to discontinue the traction to which the already-formed stitch is normally subjected by means of appropriate devices which are generally located below the needle work area.

During such knitting, since the traction normally applied to the stitch is missing, it is necessary to prevent the last formed loops from interfering with the working needles in order to obtain defect-free knitting.

Sinkers which are interposed between the needles and are actuated so as to compensate the lack of traction of the stitch are used for this purpose.

Double-needle holder knitting machines are known which are equipped with sinkers, interposed between the needles of the two needle holders, and in which the sinkers applied to one needle holder are arranged facing the sinkers applied to the other needle holder.

Each sinker is pivoted with one of its portions to the related needle holder, and its end which is nearest to the tip of the related needle has a recess which defines a protuberance which, by exploiting the oscillation of the sinker about its axis of pivoting to the needle holder, can engage the thread hooked by the needles.

Each sinker furthermore has a head which can be rested, again by exploiting the oscillability of the sinker, against the head of the sinker on the other needle holder, so as to provide a bridge between the two needle holders which prevents the already-formed knitting from returning toward the needles.

However, though the known sinkers significantly improve the quality of knittings performed in the absence of traction of the stitch, said known types of sinker have some disadvantages.

More particularly, when the knitting involves only one needle holder, two adjacent sinkers arranged on the same needle holder laterally to a same needle on the opposite sides thereof act with their protuberance on the portion of thread which joins the loops being formed on contiguous needles and astride which the previously formed loops extend.

Due to this fact, it can occur in any case that in the absence of traction of the stitch the previously formed loops can return above the tip of the needle and be engaged thereby during the forming of a subsequent loop, thus causing the undesirable forming of held stitches.

The fact of individually pivoting the sinkers to the needle holder of the machine is furthermore difficult to provide and requires relatively long times.

SUMMARY OF THE INVENTION

The aim of the present invention is to obviate the above described disadvantages by providing a knitting machine with stitch retention sinkers which can safely avoid, in the absence of traction on the stitch, any interference between the tip of the needles and the previously formed loops, particularly at the beginning of the movement of the needles toward the thread guide to engage the thread.

Within the scope of this aim, an object of the invention is to provide a machine which, in the presence of both elastic and low-elasticity threads, prevents the interference of the previously formed loops with the needle which has generated them.

Another object of the invention is to provide a machine in which the execution and assembly of the sinkers on the machine are simple and rapid to perform.

This aim, as well as these and other objects which will become apparent hereinafter, are achieved by a knitting machine with stitch retention sinkers, which comprises: a plurality of needles accommodated in grooves defined in at least one needle-holder element and being controllably movable along the longitudinal extension of the related groove from an extraction position, in which the tip of said needles protrudes from the related groove to engage at least one thread fed by a thread guide, to a retracted position, wherein the tip of said needles is retracted into the related groove to form a loop of knitting with the engaged thread, and vice versa, and a plurality of sinkers alternated with said needles, each sinker being arranged laterally to a needle, characterized in that each of said sinkers has one end which is located proximate to the tip of the related needle in said retracted position and has a tip which is directed toward the bottom of the related groove and is curved toward the related needle, actuation means being provided for the insertion of the tip of said sinker in the loop being formed on the related needle proximate to said retracted position.

BRIEF DESCRIPTION OF THE DRAWINGS

Further characteristics and advantages of the invention will become apparent from the description of a preferred but not exclusive embodiment of the machine according to the invention, illustrated only by way of non-limitative example in the accompanying drawings, wherein.

DESCRIPTION OF THE PREFERRED EMBODIMENTS

Figure 1:
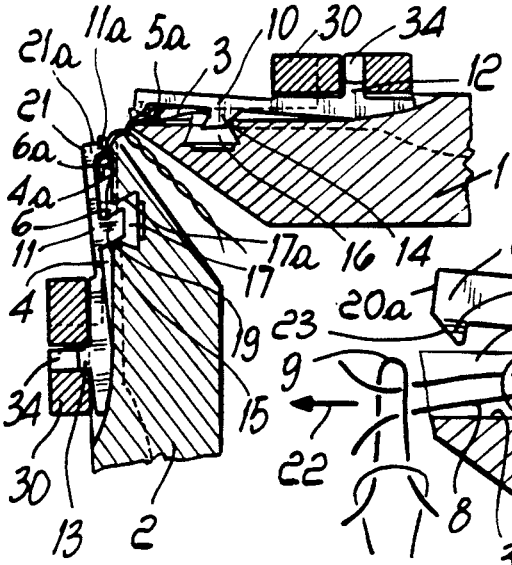
FIG. 1 is a schematic sectional view of the portion of a double needle-holder machine proximate to the work area of the needles during the completion of the step of retraction of the needles.

With reference to the above figures, the machine according to the invention, of which only a portion of the needle holders proximate to the needle work area has been schematically illustrated for the sake of simplicity, comprises two needle-holder elements 1 and 2; a plurality of grooves 3, 4 is defined in a known manner in each of said needle-holder elements. Each groove accommodates a needle 5, 6 which is controllably slidable parallel to the longitudinal extension of the related groove.

Each needle 5, 6 has, in a known manner, a heel, not illustrated for the sake of simplicity, which protrudes from the related groove in a direction which is transverse to the longitudinal extension of said groove and engages within paths defined in an assembly of cams arranged facing the needle-holder element.

Each needle, by engaging in said paths, is controllably movable, in a known manner, from an extraction position, in which its tip 5*a*, 6*a* protrudes from the related groove 3, 4 to engage a thread which is fed in a known manner by a thread guide 7, to a retracted position, in which the tip 5*a*, 6*a* of the needle is retracted into the related groove 3, 4 so as to form a new loop 8 with the engaged thread while the previously formed loop 9 is cast off, i.e. released, by the needle, and vice versa.

A sinker 10, 11 is provided laterally to each needle; said sinkers are always arranged on a same side of the needles so that in each needle holder there is always one sinker between two contiguous needles.

According to the invention, the end of each sinker which is located proximate to the tip of the related needle has a tip 10*a*, 11*a* which is directed toward the bottom 3*a*, 4*a* of the related groove and is curved toward the related needle; actuation means are furthermore provided and cause the insertion of said tip 10*a*, 11*a* in the loop 8 being formed on the related needle while said needle is proximate to its retracted position. As clearly shown in FIG. 7, the sinker tip or tip 10*a*, 11*a*, is located at the end of the sinker which is arranged adjacent to the needle tip 5*a*, 6*a*. The sinker tip 10*a*, 11*a* protrudes from the sinker 10, 11 towards the bottom 3*a*, 4*a* of the groove 3, 4. The tip 10*a*, 11*a* is also laterally curved and protrudes from the sinker 10, 11 in a direction which is transverse to the longitudinal extension of the groove 3, 4 towards the tip 5*a*, 6*a* of the immediately adjacent needle 5, 6, which is accommodated in the same groove 3, 4. In this way, as will be explained hereinafter, the tip 10*a*, 11*a* of sinker 10, 11 can be inserted into a loop 8, 9 formed on the adjacent needle 5, 6, thereby preventing a previously formed loop from being accidentally engaged by the needle 5, 6 during knitting of a successive loop.

More particularly, each sinker 10, 11 is advantageously accommodated in the same groove 3, 4 as the related needle and the actuation means comprise a main heel 12, 13 of the sinker 10, 11 which protrudes from said groove in a direction which is transverse to the longitudinal extension of said groove and can engage within a path 34 which is defined, similarly to the paths within which the heels of the needles engage, by cams 30 so as to cause a movement of the sinker along a direction which is substantially parallel to the longitudinal extension of the related groove.

The actuation means also comprise a secondary sinker heel 14, 15 which protrudes from said sinker in a direction which is transverse to the longitudinal extension of the related groove, on the side of said sinker which is directed toward the bottom 3*a*, 4*a* of the groove, and engages within a recess 16, 17 defined on the bottom of said groove.

The recess 16, 17 has a portion 16*a*, 17*a* which is inclined with respect to the longitudinal extension of the related needle, and the secondary heel 14, 15 rests against said portion when the sinker is moved by the cams 30 toward the tip of the related needle so as to cause not only the movement of the sinker in a direction which is parallel to the longitudinal extension of the groove but also a movement in a transverse direction toward the bottom 3*a*, 4*a* of the related groove to move the tip 10*a*, 11*a* into the loop 8 being formed on the needle.

On the opposite side with respect to the portion 16*a*, 17*a*, the secondary heel of the sinker has in turn an inclined portion 18, 19 which is inclined with respect to the longitudinal extension of the related groove and engages against an edge of the recess 16, 17 when the sinker is moved by the cams 30 in the opposite direction with respect to the tip of the needle.

Due to the sliding of the portion 18, 19 against the edge of the recess 16, 17, the sinker moves not only parallel to the longitudinal extension of the related groove but also transversely, moving away from the bottom of said groove and thus extracting its tip 10*a*, 11*a* from the loop 8.

Conveniently, each sinker 10, 11 has, proximate to its tip 10*a*, 11*a*, a head 20, 21 which defines a shoulder 20*a*, 21*a* which is directed toward the extraction direction 22 of the related needle.

Figure 5:
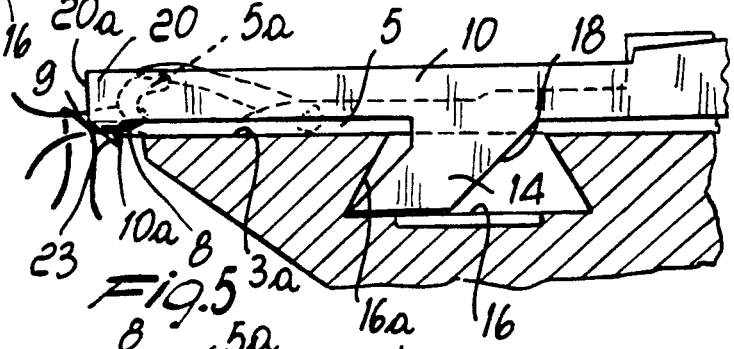
FIG. 5 is an enlarged detail view of FIG. 3.
Figure 6:
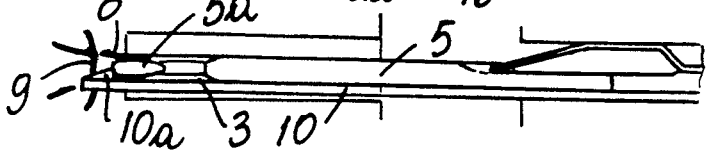
FIG. 6 is a plan view of the detail illustrated in FIG. 5.
Figure 7:
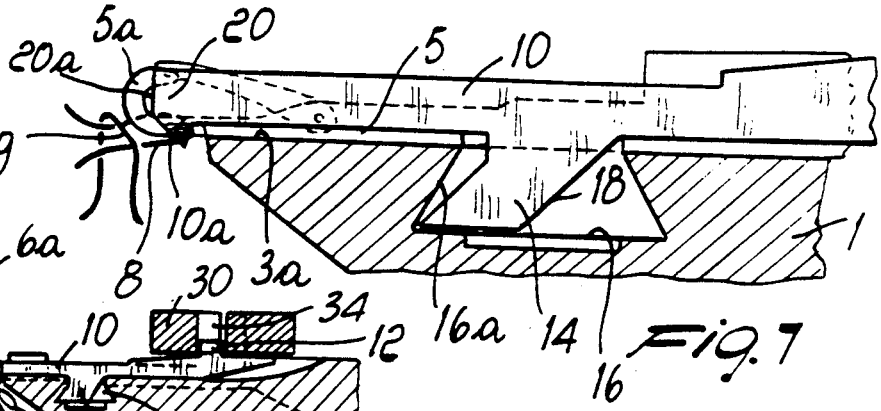
FIG. 7 is an enlarged sectional view, similar to FIGS. 2, 4 and 5, during the extraction of the needle from the related needle holder.
Figure 8:
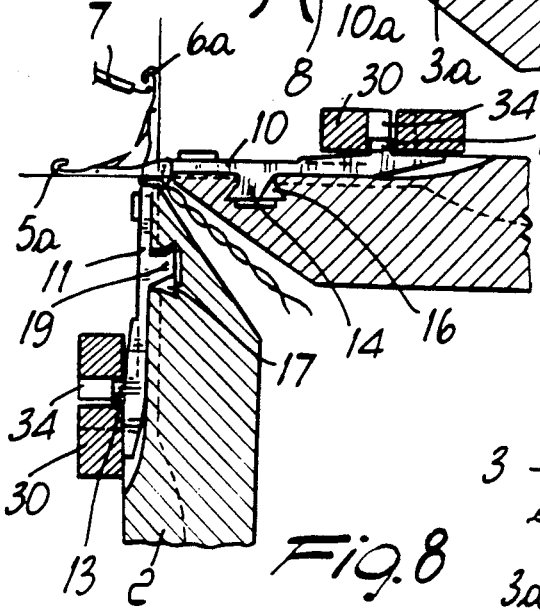
FIG. 8 is a sectional view, similar to FIGS. 1 and 3, with the needles in extraction position.
Figure 9:
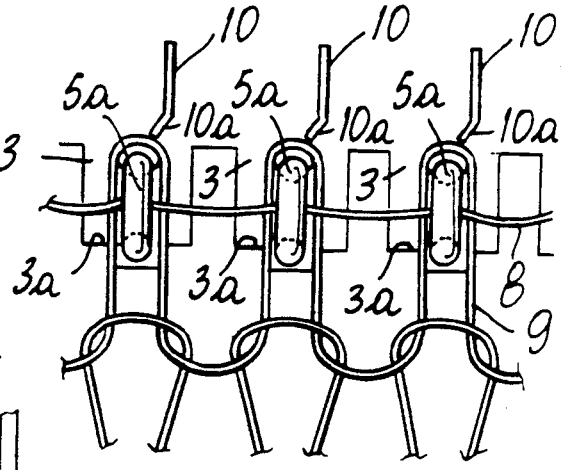
FIGS. 9 and 10 are schematic views of a needle holder of the machine seen from the tip of the needles, illustrating the actuation of the sinkers in single needle-holder knitting.

As clearly shown in FIG. 7, the shoulder 20*a*, 21*a* is located adjacent the tip 5*a*, 6*a* of the needle 5, 6. The shoulder extends transversely to the longitudinal extension of the sinker 10, 11 and the needle 5, 6, and lies substantially perpendicular to the bottom 3*a*, 4*a* of the groove 3, 4, i.e., directed towards the direction in which the contiguous needle 5, 6 is extracted from the groove 3, 4. As shown in FIG. 5 and as will be explained hereinafter, the shoulder 20*a*, 21*a*, can be extracted from the groove 3, 4 to a position whereat the shoulder 20*a*, 21*a* protrudes further from the groove 3, 4 than the tip 5*a*, 6*a* of an adjacent needle 5, 6. In this latter position, the shoulder 20*a*, 21*a* is longitudinally located between the tip 5*a*, 6*a* of the needle 5, 6 and a previously formed loop 9, with the tip 10*a*, 11*a* of the sinker 10, 11 inserted into a loop 8, 9 formed on the adjacent needle 5, 6. This prevents a cast off loop from being accidentally reengaged by the tip 5*a*, 6*a* of the needle 5, 6.

Advantageously, the tip 10*a*, 11*a* is radiused with the shoulder 20*a*, 21*a* of the head 20, 21 by an inclined radiused portion 23.

As clearly shown in the drawing figures, the inclined radiused portion 23 is inclined with respect to the longitudinal extension of the needle 5, 6 and with respect to the longitudinal extension of the groove 3, 4. The tip 10*a*, 11*a* extends from the sinker 10, 11 and is oriented towards the bottom 3*a*, 4*a* of the groove 3, 4 formed in the needle holder elements 1, 2. The tip 10*a*, 11*a* also extends transversely to the longitudinal extension of the groove 3, 4 in a curved lateral direction towards the tip 5*a*, 6*a* of the contiguous needle 5, 6 accommodated in the same groove 3, 4.

The operation of the sinkers in the machine according to the invention is as follows.

Figure 2:
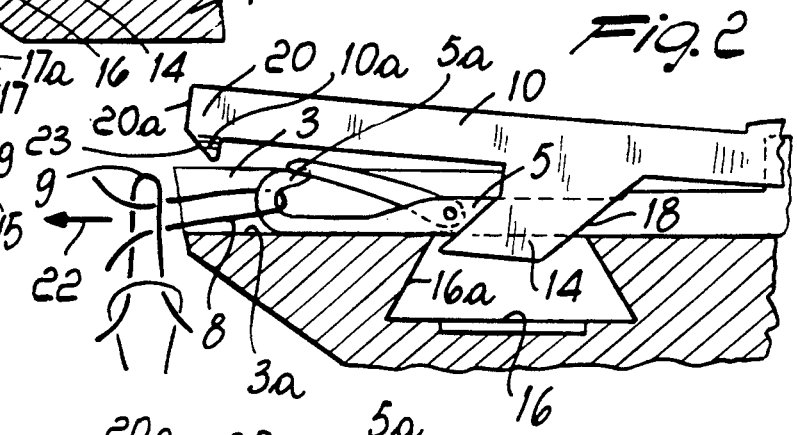
FIG. 2 is an enlarged detail view of FIG. 1.
Figure 3:
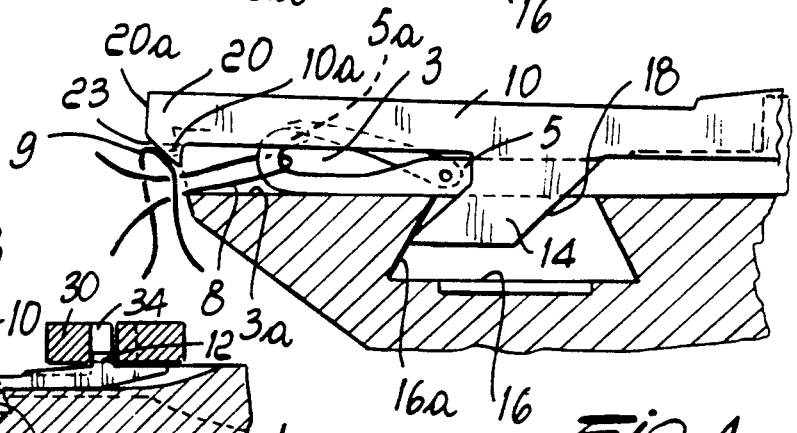
FIG. 3 is a sectional view, similar to FIG. 1, with the needles at the beginning of their passage from the retracted position to the extraction position.
Figure 4:
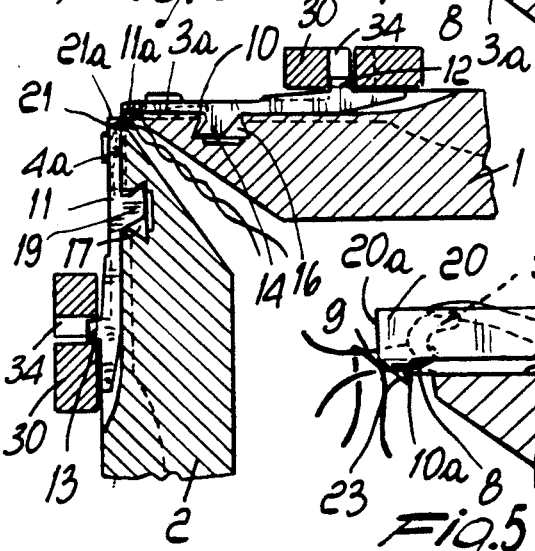
FIG. 4 is an enlarged detail view, similar to FIG. 2, in an intermediate step of the position of the needles between the position illustrated in FIG. 1 and the position illustrated in FIG. 3.

During knitting with only one needle holder of the machine, after the needles 5 or 6 have engaged the thread fed by the thread guides 7 and have returned to the retracted position, forming a new loop 8 and casting off the previously formed loop 9, the cams 30 cause the movement of the sinker 10 or 11 toward the tip of the related needle and therefore the insertion of the tip 10*a* or 11*a* in the loop 8 (FIGS. 2 and 4).

In this manner the shoulder 20*a* or 21*a* is located between the tip 5*a*, 6*a* of the related needle and the previously formed loop 9 (FIG. 5).

At this stage the needles 5 or 6 are again pushed from the retracted position to the extraction position, and during extraction the tip 5*a* or 6*a* of the needles cannot engage the previously cast-off loops 9 since said engagement is prevented by the barrier defined by the shoulders 20*a* or 21*a* of the sinkers.

It should be noted that the return of the loops 9 above the tip of the needle is prevented not only by the presence of the shoulder 20*a* or 21*a* but also by the fact that the tip 10*a*, 11*a* of the sinker is inserted in the loop 8, contrary to known sinkers which, since they do not have a tip curved toward the related needle, act on the portion of thread which connects two adjacent loops. With known sinkers, the previously formed loop is in fact loose between two adjacent sinkers and may thus interfere with the needle arranged between said two sinkers in the absence of tension of the knitting.

After the needle has gripped the thread, while the needle is retracting with its tip into the related groove, the tip 10*a* or 11*a* of the sinkers is extracted from the loop 8 so that it can be cast off by the related needle, allowing the forming of a subsequent loop.

particularly dense knitting with low elasticity threads, during the insertion of the tip 10*a* or 11*a* of the sinker in the loop 8 the inclined radiused portion 23 can act on the loop 9, spacing it from the tip of the needle and thus preventing its engagement by said needle.

Figure 11:
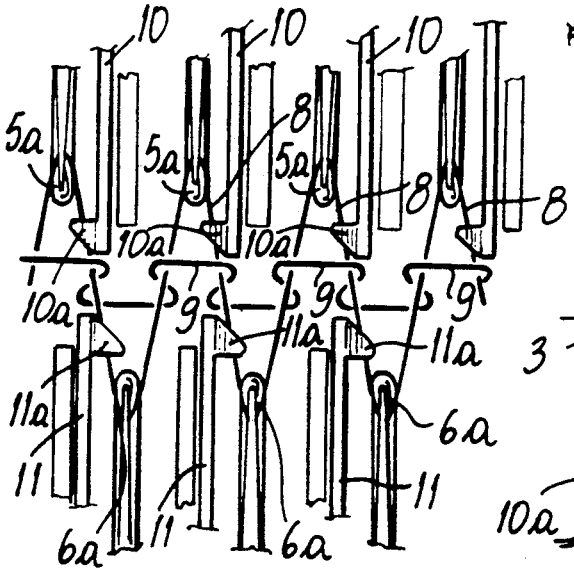
FIG. 11 is a schematic view of the two needle holder of the machine extended in a horizontal plane and seen from above during double needle-holder knitting.
Figure 10:
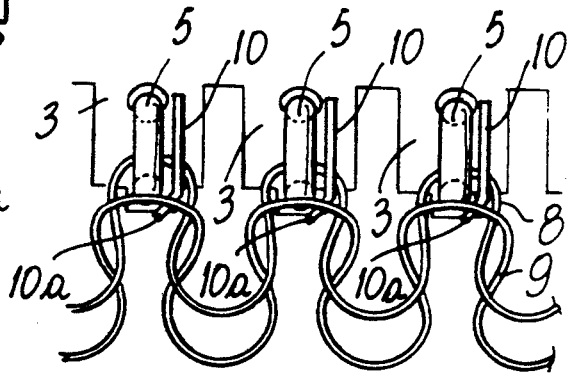

In double needle-holder knitting, as illustrated in particular in FIG. 11, the needles and the sinkers are actuated substantially as in single needle-holder knitting: in this case the interference of the previously formed loops with the needles is prevented by the two barriers constituted by the shoulders 20*a*, 21*a* when the tips 10*a*, 11*a* are inserted in the loops being formed on the needles.

In this step the mutually facing sinkers on the two needle holders do not touch one another, as instead occurs in machines with known sinkers, since the impediment to the rise of the loops 9 back toward the tip of the needle is simply caused by the tips of the sinkers inserted in the loops being formed and by the shoulders 20*a* and 21*a*.

In practice it has been observed that the machine with stitch retention sinkers according to the invention fully achieves the intended aim, since the insertion of the tip of the sinkers in the loops being formed on the needles safely prevents any interference between the previously formed loops and the tip of the needles at the beginning of their extraction to engage the thread.

Furthermore, in double needle-holder knittings, since there is no contact between the mutually facing sinkers there is less wear of the sinkers with respect to conventional machines.

Though the basic concept of the present invention has been described, for the sake of completeness, with reference to a double needle-holder machine, it can in any case be successfully adopted for the execution of machines with a single needle holder of both the circular and rectilinear types.

The machine thus conceived is susceptible to numerous modifications and variations, all of which are within the scope of the inventive concept: all the details may furthermore be replaced with technically equivalent elements.

In practice, the materials employed, as well as the dimensions, may be any according to the requirements and to the state of the art.

I claim:

1. Knitting machine with stitch retention sinkers comprising;

at least one needle holder element;

grooves defined in said needle holder element, each groove having a longitudinal extension and a bottom;

at least one thread guide;

a plurality of needles each having a needle tip, said plurality of needles being accommodated in said grooves and movable along said longitudinal extension of said grooves from an extraction position, whereat said needle tip protrudes from said groove to engage at least one thread fed by said at least one thread guide, to a retracted position, whereat said needle tip is retracted into said groove to form a loop of knitting with said thread engaged by said needle tip, and vice versa;

a plurality of sinkers arranged alternately with respect to said needles, each sinker among said plurality of sinkers being arranged laterally to one of said needles;

wherein each sinker has a sinker tip, said sinker tip being arranged proximate to said needle tip of said one needle in said retracted position, said sinker tip being oriented towards said bottom of said groove and extending transversely with respect to said longitudinal extension of said groove in a curved direction towards said one needle;

wherein said knitting machine further comprises actuation means for inserting said sinker tip into a loop formed on said one needle proximate to said retracted position; and, wherein said each groove contains one of said needles and accommodates one of said sliders laterally to said one of said needles.

2. Knitting machine according to claim 1, wherein said actuation means comprise;

a main heel defined by said sinker and protruding from said groove in a direction which is transverse to said longitudinal extension of said groove and which extends away from said bottom of said groove;

cams facing said needle holder element;

a path for said main heel defined by said cams for causing movement of said sinker along a direction of movement which is substantially parallel to said longitudinal extension of said groove.

3. Knitting machine according to claim 2, wherein said actuation means further comprise;

a recess defined on said bottom of said groove;

a secondary heel protruding from said sinker in a direction which is transverse to said longitudinal extension of said groove and which extends towards said bottom of said groove and engages in said recess;

wherein said recess and said secondary heel have mutually associated portions, said mutually associated portions being inclined with respect to said direction of movement of said sinker caused by said path defined by said cams, whereby to cause movement of said sinker tip in a direction which is transverse to said longitudinal direction of said groove upon actuation of said sinker by said cams, for insertion or extraction of said sinker tip into or from a loop being formed on said needle.

4. Knitting machine with stitch retention sinkers comprising;

at least one needle holder element;

grooves defined in said needle holder element and each having a longitudinal extension and a bottom;

at least one thread guide;

a plurality of needles each having a needle tip, said plurality of needles being accommodated in said grooves and movable along said longitudinal extension of said grooves from an extraction position, whereat said needle tip protrudes from one of said grooves to engage at least one thread fed by said at least one thread guide, to a retracted position, whereat said needle tip is retracted into said one of said grooves to form a loop of knitting with said thread engaged by said needle tip, and vice versa;

a plurality of sinkers arranged alternately with respect to said needles, each sinker among said plurality of sinkers being arranged laterally to one of said needles;

a sinker tip protruding from each of said sinkers and being arranged proximate to said needle tip of said one needle in said retracted position, said sinker tip being oriented towards said bottom of said one of said grooves and extending transversely with respect to said longitudinal extension of said groove along a curved direction to the proximity of said needle tip; and actuation means for inserting said sinker tip into a loop formed on said one needle proximate to said retracted position, whereby to prevent a cast off loop from being accidentally re-engaged by said needle tip.

5. Knitting machine according to claim 4, wherein each of said grooves contains one of said needles and accommodates one of said sliders laterally to said one of said needles.

6. Knitting machine according to claim 4, wherein said actuation means comprise;

a main heel defined by said sinker and protruding from said groove in a direction which is transverse to said longitudinal extension of said groove and which extends away from said bottom of said groove;

cams facing said needle holder element;

a path for said main heel defined by said cams for movement of said sinker along a direction which is substantially parallel to said longitudinal extension of said groove.

7. Knitting machine according to claim 6, wherein said actuation means further comprise;

a recess defined on said bottom of said groove;

a secondary heel protruding from said sinker in a direction which is transverse to said longitudinal extension of said groove and which extends towards said bottom of said groove and engages in said recess;

wherein said recess and said secondary heel have mutually associated portions, said mutually associated portions being inclined with respect to said direction of movement of said sinker caused by said path defined by said cams, whereby to cause movement of said sinker tip in a direction which is transverse to said longitudinal direction of said groove upon actuation of said sinker by said cams, for insertion or extraction of said sinker tip into or from a loop being formed on said needle.

8. Knitting machine with stitch retention sinkers comprising;

at least one needle holder element;

grooves defined in said needle holder element and each having a longitudinal extension and a bottom;

at least one thread guide;

a plurality of needles, each needle having a needle tip, said plurality of needles being accommodated in said grooves and movable along said longitudinal extension of said grooves from an extraction position, whereat said needle tip protrudes from one of said grooves to engage at least one thread fed by said at least one thread guide, to a retracted position, whereat said needle tip is retracted into said one of said grooves to form a loop of knitting with said thread engaged by said needle tip, and vice versa;

a plurality of sinkers arranged alternately with respect to said needles, each sinker among said plurality of sinkers being arranged laterally to one of said needles;

a sinker tip defined by each of said sinkers and being oriented towards said bottom of said one of said grooves, said sinker tip extending transversely with respect to said longitudinal extension of said groove along a substantially curved direction towards said needle tip, whereby said sinker tip is arranged proximate to said needle tip in said retracted position of said one needle; and actuation means for inserting said sinker tip into a loop formed on said one needle proximate to said retracted position, whereby to prevent a cast off loop from being accidentally re-engaged by said needle tip.

9. Knitting machine according to claim 8, wherein each of said grooves contains one of said needles and accommodates one of said sliders laterally to said one of said needles.

10. Knitting machine according to claim 8, wherein said actuation means comprise;

a main heel defined by said sinker and protruding from said groove in a direction which is transverse to said longitudinal extension of said groove and which extends away from said bottom of said groove;

cams facing said needle holder element;

a path for said main heel defined by said cams for movement of said sinker along a direction which is substantially parallel to said longitudinal extension of said groove.

11. Knitting machine according to claim 10, wherein said actuation means further comprise;

a recess defined on said bottom of said groove;

a secondary heel protruding from said sinker in a direction which is transverse to said longitudinal extension of said groove and which extends towards said bottom of said groove and engages in said recess;

wherein said recess and said secondary heel have mutually associated portions, said mutually associated portions being inclined with respect to said direction of movement of said sinker caused by said path defined by said cams, whereby to cause movement of said sinker tip in a direction which is transverse to said longitudinal direction of said groove upon actuation of said sinker by said cams, for insertion or extraction of said sinker tip into or from a loop being formed on said needle.

* * * * *